United States Patent [19]

Kobori

[11] 4,278,917

[45] Jul. 14, 1981

[54] DRIVING CIRCUIT FOR FLUORESCENT DISPLAY DEVICE

[75] Inventor: Youichi Kobori, Mobara, Japan

[73] Assignee: Futaba Denshi Kogyo K.K., Chiba, Japan

[21] Appl. No.: 80,036

[22] Filed: Sep. 28, 1979

[30] Foreign Application Priority Data

Oct. 9, 1978 [JP] Japan ..... 53-137888[U]

[51] Int. Cl.[3] ..... H01J 23/34; H01J 29/98

[52] U.S. Cl. ..... 315/169.1; 315/1; 315/375; 358/72; 340/701; 340/704

[58] Field of Search ..... 315/169.1, 169.3, 1, 315/375; 340/701, 704, 771, 772, 811, 812, 793, 767, 781, 758; 358/72

[56] References Cited

U.S. PATENT DOCUMENTS 4,151,444 4/1979 Jenness ..... 315/1

*Primary Examiner*—Alfred E. Smith
*Assistant Examiner*—Thomas P. O'Hare
*Attorney, Agent, or Firm*—Oblon, Fisher, Spivak, McClelland & Maier

[57] ABSTRACT

A driving circuit for fluorescent display device capable of displaying letters, figures, symbols or the like in multiple luminous colors with a constant brightness is disclosed. The driving circuit comprises a voltage controlling means for controlling an output voltage in response to inputs to be displayed in the device, a pulse generating means for generating a pulse signal having the peak value which is regulated by the voltage level of the voltage controlling means and having the pulse width which is regulated by the input to be displayed in the device, and a driving means for driving the fluorescent display device in response to the output of the pulse generating means.

3 Claims, 5 Drawing Figures

DRIVING CIRCUIT FOR FLUORESCENT DISPLAY DEVICE

BACKGROUND OF THE INVENTION

1. Field of the Invention

This invention relates to a driving circuit for fluorescent display device which displays various kinds of informations in digital or analogous form, and more particularly to a driving circuit for fluorescent display device which includes anodes for forming a pattern display portion on which a phosphor layer formed of a mixture of at least two kinds of phosphorus materials having different the luminous colours and luminous threshold voltages is deposited.

2. Description of the Prior Arts

There have been developed and put to practical use various display devices, such as for example, light-emitting diode, liquid crystal, plasma display, fluorescent display device and the like as a means for displaying various kinds of informations.

Above all, the fluorescent display device is advantageous in that it can be driven at low voltage, little electric power consumption and excellent in luminous colour. Therefore, it has been widely used in the numeral or level display portion of various kinds of electric or acoustic applicances, digital clocks and motorcars.

The fluorescent display device is driven to display characters, figures and the like by selectively impinging electrons emitted from the cathode upon a plurality of anodes which are coated with the phosphor layer. A phosphorus material generally used in the phosphor layer of the fluorescent display apparatus is ZnO;Zn system phosphor which is energized by low luminous threshold voltage, that is, approximately 1 to 2 V. Thus, the ZnO;Zn system phosphor is characteristic of emitting light of high brightness at low voltage, however, its luminous color is limited to green.

With the expansion of the applied field of the fluorescent display apparatus, there has been a strong demand for a phosphorus material capable of emitting luminous color other than green by excitation of low speed electrons similar to the ZnO;Zn system phosphor. In order to meet such demand, it has been proposed and put in practical use such phosphor that is prepared by adding a suitable amount of $In_2O_3$ or the like to $Y_2O_3$;Eu or $Y_2O_2S$;Eu phosphor, which emits luminous color of red by excitation of low speed electrons, the phosphor mixing ZnO with ZnS;Mn, Cl, which emits luminous color of yellow by excitation of low speed electrons, and the phosphor mixing $In_2O_3$ with ZnS;Ag, which emits luminous color of blue by excitation of low speed electrons.

The phosphors which emit luminous color other than that of the ZnO:Zn system phosphor are energized by luminescence threshold voltages which are different from that of the ZnO:Zn system phosphor. Furthermore, the luminescence threshold voltage of the $Y_2O_2S$;Eu+$In_2O_3$ or the ZnS;Ag+$In_2O_3$ system phosphor is variable depending upon the amount of $In_2O_3$ to be mixed.

U.S. patent application Ser. No. 9,180 now U.S. Pat. No. 4,218,636 filed Feb. 2, 1979 discloses a fluorescent display apparatus which emits different luminous colors from a single phosphor layer deposited on anodes in response to inputs to be applied to the anodes. The phosphor layer used in this type of the fluorescent display apparatus is made of a mixture of at least two kinds of fluorescent materials each having different luminous color and threshold luminous voltage, and is excited to emit the different luminous colors by controlling voltage applied to the anodes so as to correspond to the luminous threshold voltage in each of the fluorescent materials. In the fluorescent display apparatus using the mixed phosphor layer, however, it is difficult to obtain a proper brightness of the luminous display, because the variation in the luminous color in response to an increase of the anode voltage in response to the inputs brings an increase of luminous brightness as well.

BRIEF SUMMARY OF THE INVENTION

Accordingly, it is an object of the present invention to provide a driving circuit for fluorescent display device which is capable of changing the luminous color in response to magnitude or kind of inputs applied to the device and obtaining the proper luminous brightness regardless of the variance of the luminous color.

It is another object of the present invention to provide a driving circuit for fluorescent display device wherein the voltage, pulse width or pulse recurrence frequency applied to the device can be controlled in response to inputs to be displayed in the device so that the luminous display in the proper brightness in each of the colors which is variable in response to magnitude or kind of the inputs can be obtained.

It is further object of the present invention to provide a driving circuit for fluorescent display device which renders the luminous display of multiple colors distinctly visible so as to remarkably enhance the display effect and to make a variety of the luminous displays possible.

According to the present invention, the foregoing and other objects are attained by providing a fluorescent display device which comprises one or more anodes having fluorescent substance layer deposited on the upper surface thereof for a luminous display in the form of, numerical letters, figures, symbols or the like upon impingement of thermions emitted from cathodes. The fluorescent layer deposited on at least one of the anodes is prepared by mixing two or more fluorescent materials having different luminous colors and different threshold luminous voltages from each other. The fluorescent display device is provided with a voltage controlling means which controls an output voltage in response to inputs to be displayed in the device, a pulse generating means which generates a pulse signal having the peak value which is regulated by the voltage level of the voltage controlling means and having the pulse width or pulse-recurrence frequency which is regulated by the inputs to be displayed in the device, and a driving means which receives the outputs from the pulse generating means to drive the fluorescent display device.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference characters designate the same or similar parts throughout the figures thereof and wherein.

DETAILED DESCRIPTION OF THE PREFERRED EMBODIMENTS

Now, a fluorescent display device according to the present invention will be hereinafter described by way of example with reference to the accompanying drawings.

Figure 1:
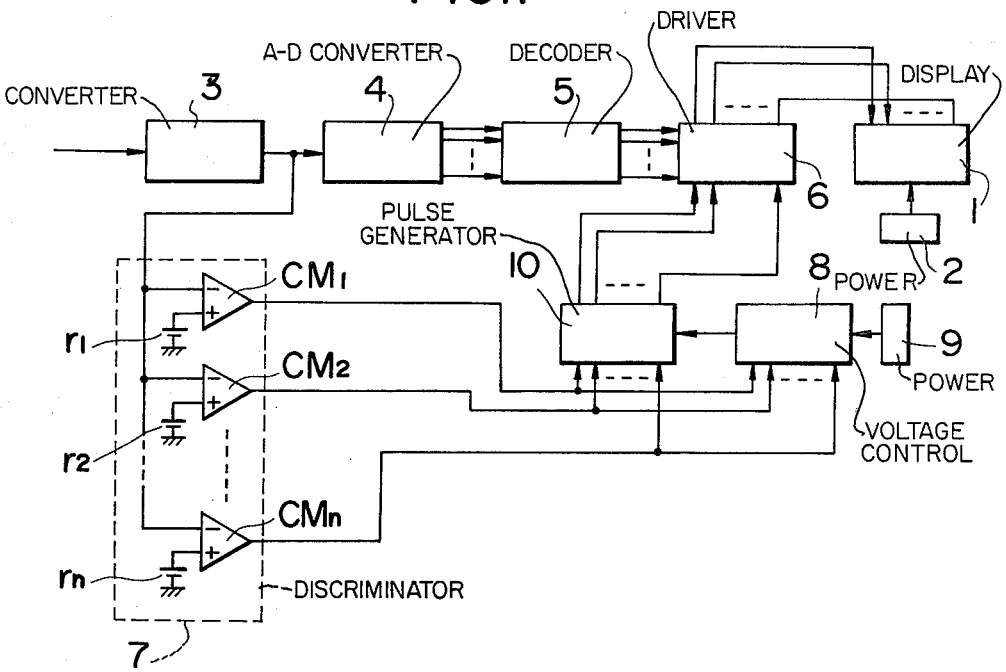
FIG. 1 is a block diagrammatic view of a fluorescent display device according to an embodiment of the present invention.
Figure 2:
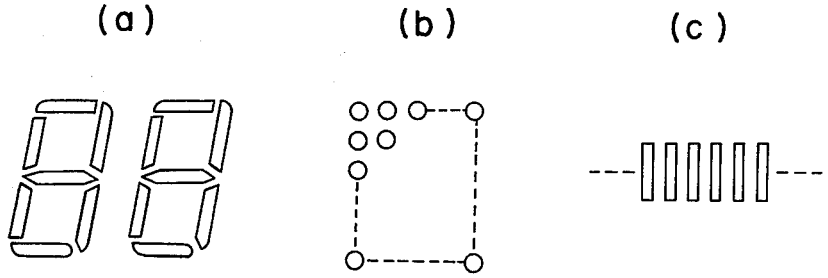
FIG. 2(*a*) to FIG. 2(*c*) respectively show different examples of pattern display sections to be applicable to a fluorescent display device according to the present invention.

Referring now to FIG. 1 which shows a block diagrammatic view of the fluorescent display device according to an embodiment of the present invention, reference numeral 1 designates the fluorescent display device which includes a pattern display section consisting of seven segment anodes arranged in the shape of the letter "8" as shown in FIG. 2(*a*). The pattern display section shown in FIG. 2(*b*) comprises dot-shaped anodes arranged at a distance in a matrix form, and the pattern display section shown in FIG. 2(*c*) consists of anodes which are of rectangular in shape and are linearly disposed at a distance. The pattern display section may be formed in any suitable pattern depending upon the purpose of the display. At least one of the anodes is coated with a mixed fluorescent layer comprising a mixture of at least two fluorescent materials having different luminous colors and different dead voltages. For example, in the fluorescent display device designed to selectively display the luminous colors of green and red, a mixture of suitable amount of ZnO;Zn and $Y_2O_2S$;Eu+$InsO_3$ system phosphors is deposited on the anodes through the conventional precipitating method, printing method or electrodeposition.

Reference numeral 2 designates a power source for cathode which emits electrons upon heating with electric current. Reference numeral 3 designates a converter which converts inputs representing various kinds of physical quantities such as, for example, temperature, sound volume, light volume, or revolution number into voltage. When the output from a sensor measuring various kinds of the physical quantities is represented by voltage, the converter 3 is not required. Reference numeral 4 is an AD converter which converts an analogue value which is given as the voltage from the voltage converter 3 into digital values, for example, a BCD signal. Reference numeral 5 represents a decoder for distributing the digital values from the AD converter 4 to the predetermined anodes in the fluorescent display device 1. Reference numeral 6 designates a driver which applies anode voltages sufficient to drive each of the anodes of the fluorescent display device 1 in response to the outputs from the decoder 5.

Reference numeral 7 designates a discriminator circuit which discriminates the outputs from the voltage converter 3 in plural levels, and includes reference power sources $r_1$, $r_2$ . . . $r_n$ having different voltages respectively and comparators $CM_1$, $CM_2$ . . . $CM_n$. Reference numeral 8 designates a voltage controlling means which controls the voltage from a driving power source 9 in response to the outputs from the discriminator circuit 7 and generates an output to a pulse generating means 10. The pulse generating means 10 generates pulses having the pulse width corresponding to the outputs from the discriminator circuit and having the peak value corresponding to the output voltage from the voltage controlling means 8. The outputs from the pulse generating means 10 are amplified by the driver 6 and then applied to each of the anodes of the fluorescent display device 1 as the anode voltage so as to effect the luminous display of characters, figures and the like.

Referring now to the operation of the fluorescent display device, the fluorescent display device 1 according to the present invention includes the anodes on which the mixture of a suitable amount of ZnO;Zn and $Y_2O_2S$;Eu+$In_2O_2$ system phosphors is deposited so as to selectively display the luminous colors of green and red in response to magnitude of the inputs as explained hereinabove. The ZnO;Zn system phosphor is excited by 1–2 V of dead voltage, while the $Y_2O_2S$:Eu+$In_2O_3$ system phosphor is excited by about 20 V of dead voltage, although it depends upon the amount of $In_2O_3$ to be mixed.

First, a level $L_1$ for discriminating the output to effect the luminous display of green and red is determined, and then the output voltage of the reference power source $r_1$ in the discriminator circuit 7 is set corresponding to the discrimination level. In this case, a single reference power source and comparator will do in the discriminator circuit 7.

When the output voltage of the converter 3 is less than the discrimination level $L_1$, the output of the comparator $CM_1$ becomes a logical value, for example, "1," thereby to regulate the output of the voltage controlling means 8 to which the output of the driving power source 9 is applied in the first voltage $V_1$.

The voltage $V_1$ is determined within the range which is higher than the luminous threshold voltage of the ZnO:Zn phosphor and is not exceeded too much to the luminous threshold voltage of the $Y_2O_2S$;Eu+$In_2O_3$ system phosphor, as for example, 10–20 V.

The output of the voltage controlling means 8 is applied to the pulse generating means 10 in which the output is converted to pulses having the peak value corresponding to the output. Furthermore, the pulses are regulated by the binary signal "1" of the comparator $CM_1$ so as to have the predetermined pulse width.

In this manner, the pulses having the peak value regulated by the voltage controlling means 8 and having the pulse width regulated by the pulse generating means 10 are applied to the predetermined anodes of the fluorescent display device 1 through the driver 6, thereby to excite the anodes and effect the luminous display of characters, figures or the like corresponding to the magnitude of the inputs to be displayed in the display device in green color. In this case, if the output of the converter 3 does not exceed to the discrimination level $L_1$, the output of the comparator $CM_1$ maintains the binary signal "1," which makes the peak value and pulse width of the pulses supplied to the driver 6 constant.

Generally, luminous brightness of each of the anodes in the fluorescent display device is in proportion to the electric power consumed in the anodes. Thus, the luminous brightness is kept constant as long as the pulses having the constant peak value and pulse width are applied to the fluorescent display device 1. In other words, if the output of the voltage converter 3 is below the discrimination level $L_1$, the fluorescent display device 1 effects the luminous display of the input in green color with the constant brightness at all times regardless of the magnitude of the input.

On the other hand, when the output of the voltage converter 3 exceeds to the discrimination level $L_1$, the output of the comparator $CM_1$ is reversed to be the other logical value, for example "0", thereby to switch the output of the voltage controlling means 8 in a second voltage $V_2$. In this case, the voltage $V_2$ is set in advance in a voltage which exceeds too much to the luminous threshold voltage of the $Y_2O_2S;Eu+In_2O_3$ system phosphor, as for example, about 40 V. Furthermore, the pulse generating means 10 is controlled by the output of the comparator $CM_1$ and regulates the pulse width when the voltage supplied from the voltage controlling means is converted into pulses.

The pulse width is determined so that the luminous brightness observed in the excitation of the fluorescent display device 1 with the pulses may be substantially equivalent to that of the ZnO;Zn system phosphor which emits green color in view of the luminous efficiency of the $Y_2O_2S;Eu+In_2O_3$ phosphor.

As explained hereinabove, according to the present invention, the fluorescent display device 1 effects the luminous display of the input in red color with the constant luminous brightness regardless of the magnitude of the input when the output of the voltage converter 3 exceeds to the discrimination level $L_1$, because the peak value and pulse width of the pulses for the energization of the fluorescent display device 1 are constant.

In this manner, it makes possible to selectively exhibit the luminous display of green and red colors on the same anode when the input exceeds to the predetermined discrimination level. The luminous display in the fluorescent display device 1 according to the present invention is extremely easy to observe, because the luminous brightness of each of the colors is always the predetermined value regardless of the magnitude of the input.

According to the present invention, it is to be understood that the display color in the fluorescent display device 1 is not limited to green and red. A mixed color of green and red can be displayed by setting up a second discrimination level $L_2$ by changing the voltage of the reference power source $r_2$ in the discriminator circuit 7, and controlling each of the outputs of the voltage controlling means 8 and the pulse generating means 10 by the combination of the logical values of the outputs of the comparators $CM_1$ and $CM_2$.

In the same manner, the fluorescent display device 1 may be constructed to include the anodes on which a mixed phosphor layer containing more than three fluorescent materials each having different luminous color and luminous threshold voltage so that the luminous display of more than three colors may be displayed in response to the inputs to be applied to the fluorescent display device by setting up the appropriate discrimination levels by changing the voltage of the reference power sources $r_1, r_2 \ldots r_n$ respectively in the discriminator circuit 7, and controlling each of the outputs of the voltage controlling means 8 and the pulse generating means 10 by the combination of the logical values of the outputs of the comparators $CM_1, CM_2 \ldots CM_n$.

In the embodiments explained hereinabove, the discriminating function in the discrimination circuit 7 is effected in response to the magnitude of the inputs to be displayed in the device, however, according to the present invention, it is possible to actuate the discriminator circuit 7 in response to the kind of the inputs so that each of the inputs may be luminously displayed in different colors, respectively. This is particularly useful when a plurality of sensor outputs are displayed in the single fluorescent display device 1.

In the above embodiment, the change of the luminous colors is effected by the discrimination of the voltages corresponding to the inputs, however, it is possible to switch the luminous color directly with the use of the outputs of the AD converter 4 by making the voltage controlling means and the pulse forming means the discriminating function of the digital signals. This embodiment will be hereinafter described with reference to FIG. 3.

Figure 3:
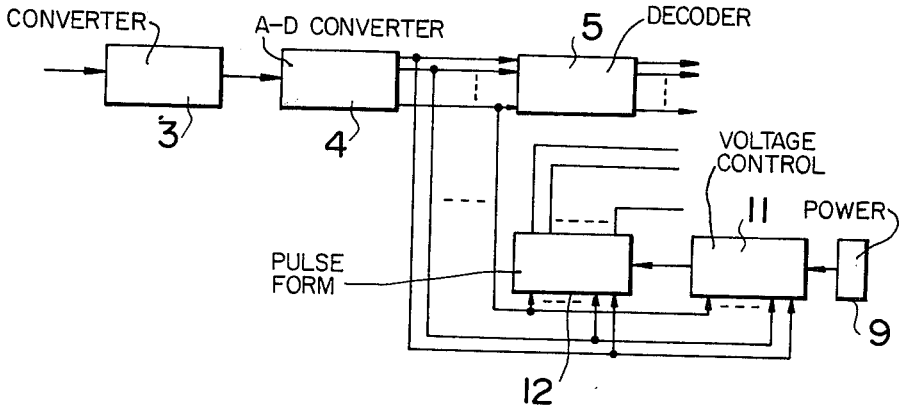
FIG. 3 is a partial block diagrammatic view of a fluorescent display device according to another embodiment of the present invention.

In FIG. 3, reference numerals 11 and 12 designate a voltage controlling means and a pulse generating means respectively each having the discriminating function of the digital signals. The outputs of the AD converter 4 are directly applied to the voltage controlling means 11 and the pulse forming means 12 respectively. The peak value and the pulse width of the pulses supplied to the driver are controlled by the digital signals, thereby to vary the luminous color emitted from the fluorescent display device corresponding to the inputs to be applied and to keep the luminous brightness in each of the colors the most proper value regardless of the magnitude of the inputs.

Figure 4:
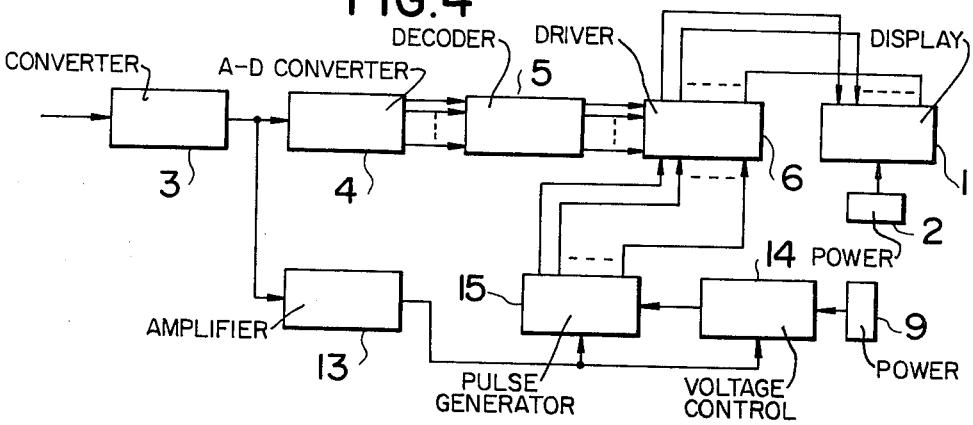
FIG. 4 is a block diagrammatic view of a fluorescent display device according to another embodiment of the present invention.

FIG. 4 shows another embodiment of the present invention. In this embodiment, the luminous color is continuously varied corresponding to the inputs to be applied to the device by amplifying the output of the voltage converter 3 up to an appropriate level by an amplifier 13, and then each of the outputs of the voltage controlling means 14 and the pulse generating means 15 is controlled by the output of the amplifier 13.

In the embodiment shown in FIG. 4, the fluorescent display device is formed to include the phosphor layer made of the mixture of ZnO;Zn and $Y_2O_2S;Eu+In_2O_3$ phosphor so as to emit the luminous colors which are continuously changing from green—greenish red—reddish green to red with the constant luminous brightness in each of the colors in response to the inputs to be applied by increasing the output level of the voltage controlling means 14 in accordance with the increase of the inputs and controlling the pulses generated from the pulse generating means 15 so as to have narrow pulse width.

In the above embodiments, although the pulse width of the pulses supplied to the driver 6 is controlled in order to keep the luminous brightness in each of the colors the most appropriate luminous value, it is to be understood that the pulse-recurrence frequency or duty factor may be controlled for regulating the electric power consumed at each of the anodes of the fluorescent display device 1.

Figure 5:
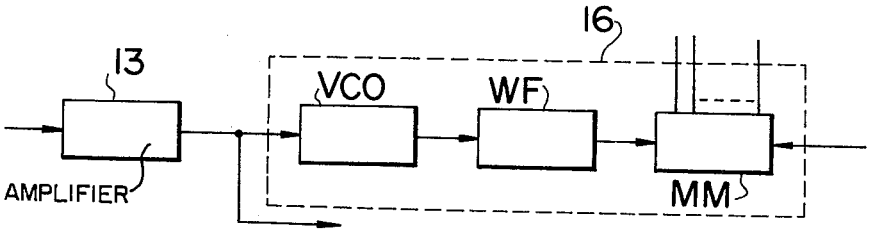
FIG. 5 is a partial block diagrammatic view of a fluorescent display device according to another embodiment of the present invention.

FIG. 5 shows an example for controlling the pulse-recurrence frequency. In FIG. 5, a pulse generating means 16 comprises a voltage control oscillator (VCO) for changing the frequency of the output pulses in response to the magnitude of the input voltage, a wave-form shaping means (WF) for shaping the wave-form of the output of the voltage control oscillator, and a monostable multi-vibrator (MM) which is triggered by the output of the wave-form shaping means (WF).

The pulse forming means 16 shown in FIG. 5 is operated by applying the output of the amplifier 13 shown in FIG. 4 to the voltage control oscillator (VCO). Then, the pulse-recurrence frequency of the pulses supplied to the driver 6 is regulated and the luminous brightness of each of the colors are controlled in the most suitable luminous value.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. In a driving circuit for fluorescent display device which comprises anodes for forming a pattern display section, a phosphor layer deposited on said anodes, said phosphor layer deposited on at least one of said anodes being composed of mixed fluorescent materials each having different luminous color and threshold luminous voltage, a filamentary cathode for emitting thermions when energized and heated, whereby characters, figures and the like are displayed when thermions emitted from said cathode impinge said phosphor layer, the improvement which comprises:

a means for controlling an output voltage in response to an input to be displayed in said fluorescent display device;

a means for generating pulse signals having a peak value regulated by the output voltage of said voltage control means and having a pulse width or pulse-recurrence frequency regulated by the input to be displayed in said fluorescent display device; and a means for driving said fluorescent display device in response to the output of said pulse generating means.

2. The driving circuit for fluorescent display device according to claim 1 wherein said pulse generating means generates the pulse signals having the predetermined peak value, pulse width and pulse-recurrence frequency within a discrimination level of the input to be displayed in said fluorescent display device.

3. The driving circuit for fluorescent display device according to claim 1 wherein said pulse generating means generates the pulse signals continuously changing its peak value, pulse width and pulse-recurrence frequency in response to the input to be displayed in said fluorescent display device.

* * * * *